US005349178A

United States Patent [19]

Mattern et al.

[11] Patent Number: 5,349,178

[45] Date of Patent: Sep. 20, 1994

[54] IMAGE INTENSIFIER WITH PROTECTED IMAGE SENSOR

[75] Inventors: Detlef Mattern, Erlangen; Arnulf Oppelt, Spardorf; Hartmut Sklebitz, Erlangen, all of Fed. Rep. of Germany

[73] Assignee: Siemens Aktiengesellschaft, Munich, Fed. Rep. of Germany

[21] Appl. No.: 81,826

[22] Filed: Jun. 22, 1993

[30] Foreign Application Priority Data

Jun. 22, 1992 [EP] European Pat. Off. ..... 92110505.2

[51] Int. Cl.[5] ..... H01J 31/50

[52] U.S. Cl. ..... 250/214 VT; 313/527

[58] Field of Search ..... 250/207, 214 VT, 333, 250/208.1, 483.1; 313/479, 527, 530

[56] References Cited

U.S. PATENT DOCUMENTS 4,213,055 7/1980 Schrijivers et al. ..... 250/483.1
4,564,753 1/1986 Van Aller et al. ..... 250/207
5,093,566 3/1992 Van Aller ..... 313/527
5,157,303 10/1992 Polaert ..... 250/214 VT

FOREIGN PATENT DOCUMENTS 0083240 7/1983 European Pat. Off. .
0334734 9/1989 European Pat. Off. .
0406955 1/1991 European Pat. Off. .
0474549 3/1992 European Pat. Off. .

*Primary Examiner*—David C. Nelms
*Assistant Examiner*—Stephone B. Allen
*Attorney, Agent, or Firm*—Hill, Steadman & Simpson

[57] ABSTRACT

An x-ray image intensifier has an evacuated housing, an input luminescent screen, electron optics, and an image sensor disposed inside the housing at a side of the housing opposite the input luminescent screen. The image sensor is covered by a protective layer which effects a deceleration of the incident electrons, the protective layer being applied on that side of the image sensor facing the input luminescent screen.

9 Claims, 1 Drawing Sheet

IMAGE INTENSIFIER WITH PROTECTED IMAGE SENSOR

BACKGROUND OF THE INVENTION

1. Field of the Invention

The present invention is directed to an x-ray image intensifier of the type having an evacuated housing, an input luminescent screen, electron optics, and an image sensor disposed inside the housing at the side of the housing disposed opposite the input luminescent screen.

2. Description of the Prior Art

An x-ray image intensifier of the type described above is disclosed in European Application 0 083 240, which is used as part of a medical x-ray examination apparatus. The x-ray image intensifier supplies two-dimensional transillumination exposures in the form of video images. The x-ray quanta are absorbed in a scintillator of the input luminescent screen, and are thereby converted into light. The emitted light quanta release electrons in a photocathode of the input luminescent screen. These electrons are accelerated in the electrical field of the electron optics, and are focused onto an image sensor which converts the electron image into a video image, and supplies corresponding video signals. The video signals can then be further processed in a digital imaging system or can be used for video image presentation. Image sensors such as solid-state image pick-ups are employed in such known devices which are usually based on the charge-shift principle (CCD), and are suitable in their standard embodiment for the documentation of photons in the visible range. Backside-thinned CCDs can be employed for the detection of electrons.

By contrast to photons, electrons leave effects along their entire passage through a material. In the electron irradiation of a CCD from the front side, the extremely thin, insulating layer is also affected. This layer may consist, for example, of $SiO_2$ and separates the conductive shift structures (gates) from the semiconductor substrate. The demands made of this insulating layer are extremely high because of the high field strengths which are present in such devices. Irradiation of this layer with charged particles, for example electrons, leads to the formation of quasi-stationary ions, and thus to the formation of intermediate conditions (F centers) in the band gap of the $SiO_2$. These traps result in an increased dark current, and also degrade the charge transfer efficiency. Such charging effects also result in a modification of the shift potential at the gates.

In backside-thinned CCDs, the substrate on which the active layers are applied, in an epitaxial process, are substantially completely removed in a complicated, expensive process. In such backside-thinned CCDs, however, it is possible to allow the CCD to be exposed to radiation at the thinned side with short-range particle beams, for example electrons in the keV range, because the electrons are completely decelerated in the backside layer, and thus do not have a negative effect on the insulating layer. Such CCDs, however, are relatively expensive and are not consistent in quality.

SUMMARY OF THE INVENTION

It is an object of the present invention to provide an image intensifier having an image sensor wherein the image sensor is protected against incident electrons, so that the sensor can be used without difficulty in an environment, such as an x-ray image intensifier, wherein it will be exposed to such electrons.

The above object is achieved in accordance with the principles of the present invention in an image intensifier having an image sensor with a protective layer applied on that side of the image sensor facing toward the input luminescent screen of the x-ray image intensifier. This protective layer effects a deceleration of incident electrons. The protective layer decelerates the electrons to such an extent that they no longer reach the image sensor itself. The protective layer preferably has an adequate electrical conductivity so that the formation of F-centers is suppressed.

It is preferable, particularly for reducing the thickness of the protective layer, that the protective layer be composed of a material having a high specific weight, for example an indium-tin-oxide compound or lead glass. If an optical image sensor having a preceding luminescent layer is employed, the protective layer must be transparent. The protective layer can be arranged between an optical CCD transducer and a luminescent layer.

DESCRIPTION OF THE PREFERRED EMBODIMENTS

Figure 1:
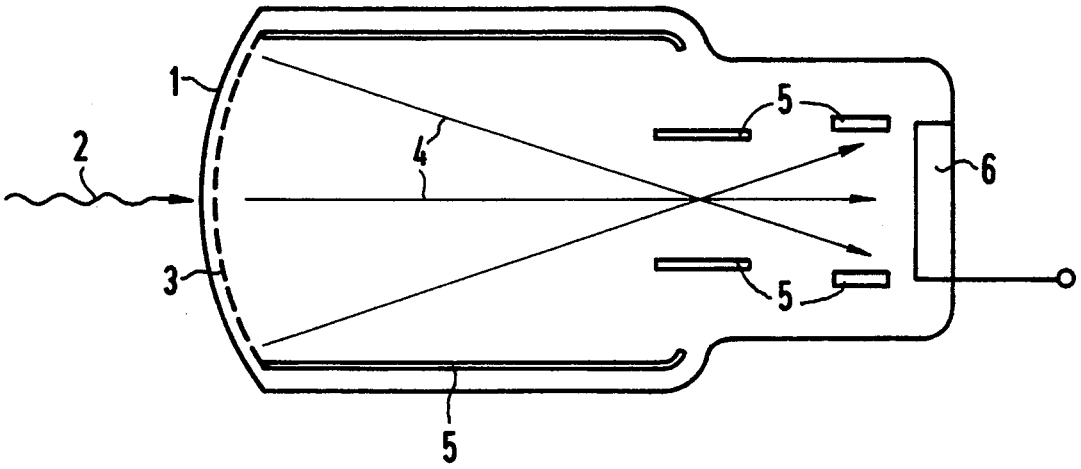
FIG. 1 is a schematic side view of a known x-ray image intensifier with image sensors.

The basic components of an x-ray image intensifier are shown in FIG. 1. The x-ray image intensifier of FIG. 1 includes an evacuated housing 1 on which x-rays 2 are incident. At the side of the housing 1 facing toward the x-rays 2, the x-ray image intensifier has an input luminescent screen 3 disposed inside of the housing 1. The input luminescent screen 3 contains a luminescent layer applied on a photocathode. Electrons 4 emanating from the photocathode are accelerated and focused onto an image sensor 6 by electron optics 5. The image sensor 6 converts the incident electrons 4 into an electrical signal, which is further processed as a video signal for reproduction of an image on a monitor.

Figure 2:
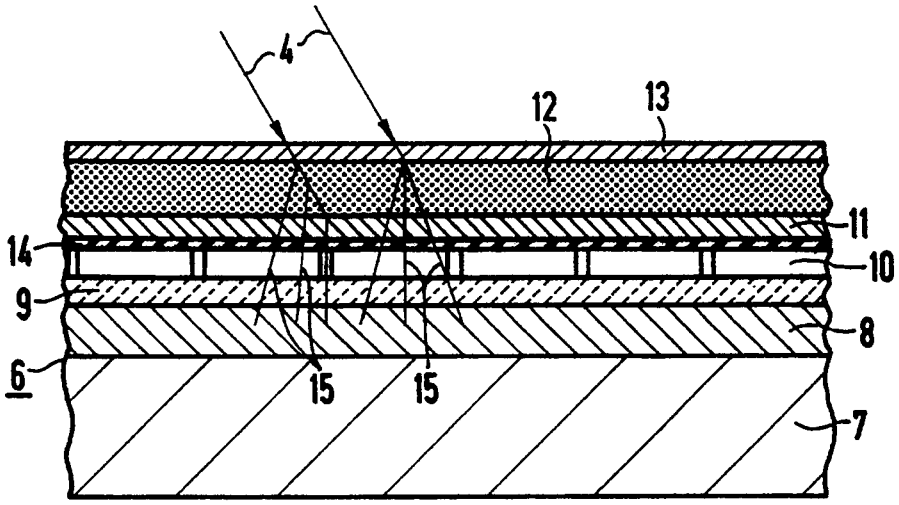
FIG. 2 is a sectional view through a portion of a CCD transducer in an x-ray image intensifier constructed in accordance with the principles of the present invention.

A cross section through an image sensor 6 constructed in accordance with the principles of the present invention is shown in FIG. 2, in the form of a CCD transducer. The CCD transducer includes an epitaxial layer 8 for charge collection and transport of the electrons. The epitaxial layer 8 is applied on a substrate 7, and the epitaxial layer 8 is covered by a $SiO_2$ insulation layer 9. Gate structures 10 are situated on the $SiO_2$ insulation layer 9. A protective layer 11, in accordance with the principles of the present invention, is disposed between the gate structures 10 and a phosphor layer 12. The protective layer 11 may, for example, be composed of indium-tin-oxide (ITO). An electron-transmissive aluminum layer 13 is applied on the phosphor layer 12. The aluminum layer 13 reflects light emitted by the phosphor layer 12 toward the interior of the x-ray image intensifier back onto the CCD transducer.

Since the protective layer 11 may be electrically conductive, an electrical insulation layer 14 can be provided between the protective layer 11 and the gate structures 10.

The electrons 4 are incident on the image sensors 6, and penetrate the aluminum layer 13 and the phosphor layer 12. Photons 15 are generated in the phosphor layer 12, which can penetrate the optically transparent protective layer 11, and are detected by the image sensor 6 and can be read out therefrom in the form of charge packets. The electrons 4, which can penetrate through the granular, porous structure of the thin phosphor layer 12, however, are prevented from further passage by the protective layer 11, so that they are not incident on the image sensor 6, and thus cannot damage the image sensor 6.

The protective layer 11, instead of being an ITO layer, may be a layer of, for example, lead glass or amorphous silicon (aSi). The properties of these different materials which are important to the inventive concept disclosed herein are that they provide a protective layer which is optically transparent protective and which has a high specific weight in order to maintain effective optical thickness of the layer as small as possible but to ensure as complete electron absorption as possible, independently of the type of luminescent layer which is employed.

Although modifications and changes may be suggested by those skilled in the art, it is the intention of the inventors to embody within the patent warranted hereon all changes and modifications as reasonably and properly come within the scope of their contribution to the art.

We claim as our invention:

1. An image intensifier comprising:

an evacuated housing;

an input luminescent screen disposed in said housing which produces electrons corresponding to radiation incident thereon;

means for focusing said electrons to produce a focused electron stream;

an image sensor disposed inside said housing at a side of said housing disposed opposite said input luminescent screen, said image sensor being damageable by electrons; and a protective layer disposed on a side of said image sensor facing toward said input luminescent screen consisting of a material which decelerates electrons incident on said protective layer.

2. An image intensifier as claimed in claim 1 wherein said protective layer consists of material having an electrical conductivity which suppresses the formation of F centers.

3. An image intensifier as claimed in claim 1 further comprising an insulation layer disposed between said protective layer and said image sensor means.

4. An image intensifier as claimed in claim 1 wherein said protective layer consists of a material having a high specific weight.

5. An image intensifier as claimed in claim 1 wherein said protective layer consists of an indium-tin-oxide compound.

6. An image intensifier as claimed in claim 1 wherein said protective layer consists of lead glass.

7. An image intensifier as claimed in claim 1 wherein said protective layer consists of amorphous silicon.

8. An image intensifier as claimed in claim 1 wherein said image sensor comprises an optical image sensor, and wherein said image intensifier includes a luminescent layer preceding said image sensor, and wherein said protective layer is transparent to light emitted by said luminescent layer.

9. An image intensifier as claimed in claim 1 wherein said image sensor comprises an optical CCD transducer and wherein said image intensifier further includes a luminescent layer, with said protective layer being disposed between said luminescent layer and said optical CCD transducer.

* * * * *